US008770000B2

(12) United States Patent
Loreti

(10) Patent No.: US 8,770,000 B2
(45) Date of Patent: Jul. 8, 2014

(54) PROGRAMMABLE CYLINDER LOCK WHICH DOES NOT REQUIRE A SPECIAL CHANGE KEY

(75) Inventor: Alberto Loreti, Antrodoco (IT)

(73) Assignee: Rielda Serrature s.r.l., Fiumicino (IT)

( * ) Notice: Subject to any disclaimer, the term of this patent is extended or adjusted under 35 U.S.C. 154(b) by 0 days.

(21) Appl. No.: 13/574,669

(22) PCT Filed: Dec. 8, 2010

(86) PCT No.: PCT/EP2010/007624

§ 371 (c)(1),
(2), (4) Date: Jul. 23, 2012

(87) PCT Pub. No.: WO2011/091832

PCT Pub. Date: Aug. 4, 2011

(65) Prior Publication Data

US 2012/0304717 A1 Dec. 6, 2012

(30) Foreign Application Priority Data

Jan. 27, 2010 (IT) ..... TO 2010A0048

(51) Int. Cl.
*E05B 29/04* (2006.01)
*E05B 31/00* (2006.01)
*E05B 29/00* (2006.01)

(52) U.S. Cl.
CPC ..... *E05B 29/004* (2013.01); *E05B 31/00* (2013.01)
USPC ..... 70/383; 70/384; 70/492; 70/493; 70/495

(58) Field of Classification Search
USPC ..... 70/337–343, 382–385, 368, 492–496
See application file for complete search history.

(56) References Cited

U.S. PATENT DOCUMENTS

| | | | | |
|---|---|---|---|---|
| 4,712,399 | A | 12/1987 | Mattossovich | |
| 4,966,021 | A * | 10/1990 | Boag | 70/383 |
| 6,959,569 | B2 * | 11/2005 | Strader et al. | 70/492 |
| 7,007,528 | B2 * | 3/2006 | Chong et al. | 70/492 |

(Continued)

FOREIGN PATENT DOCUMENTS

| | | |
|---|---|---|
| EP | 0226252 | 6/1987 |
| EP | 0900310 | 3/1999 |
| WO | 9840589 | 9/1998 |

OTHER PUBLICATIONS

International Search Report, dated Mar. 31, 2011, in the corresponding PCT application.

*Primary Examiner* — Christopher Boswell
(74) *Attorney, Agent, or Firm* — Young & Thompson

(57) ABSTRACT

A lock with a programming device, includes a stator, a rotor rotatably inserted therein, a keyhole, a longitudinal groove, a set of key followers and a set of locking pins which, under control of a change bar, can be mutually engaged for normal operation and disengaged in a change condition, and can be moved or blocked under control of a stop bar provided with springs which stress the stop bar outwards. The change bar is arranged to keep or assume, even in the change condition, a position in which it retains the engagement among at least some of the key followers and locking pins. A change element displaces the change bar to the position in which it disengages all the key followers from the locking pins, when the user intends to proceed with the change of the key. A device for preventing a faulty programming is provided.

10 Claims, 5 Drawing Sheets

(56) References Cited

U.S. PATENT DOCUMENTS

| | | | | |
|---|---|---|---|---|
| 7,434,431 | B2 * | 10/2008 | Armstrong et al. | 70/492 |
| 7,448,240 | B1 * | 11/2008 | Huang et al. | 70/492 |
| 7,584,635 | B2 * | 9/2009 | Gan et al. | 70/492 |
| 7,878,036 | B2 * | 2/2011 | Armstrong et al. | 70/492 |
| 7,980,104 | B1 * | 7/2011 | Huang | 70/492 |
| 8,117,876 | B2 * | 2/2012 | Mathachan | 70/492 |
| 8,161,783 | B2 * | 4/2012 | Huang et al. | 70/492 |
| 8,316,676 | B2 * | 11/2012 | Chiang et al. | 70/492 |
| 2004/0060331 | A1 | 4/2004 | Armstrong et al. | |
| 2005/0217330 | A1 | 10/2005 | Chong et al. | |
| 2009/0277234 | A1 | 11/2009 | Huang et al. | |
| 2009/0277236 | A1 | 11/2009 | Huang et al. | |

* cited by examiner

PROGRAMMABLE CYLINDER LOCK WHICH DOES NOT REQUIRE A SPECIAL CHANGE KEY

BACKGROUND OF THE INVENTION

The present invention concerns a programmable cylinder lock, namely a lock comprising devices intended to allow, through a change operation, to modify the former lock codification in order to adjust the lock for being operated by a key different from the key to which the lock was formerly adapted.

More particularly, the invention concerns improvements in a kind of programmable cylinder lock which is known from the European Patents Nos. 0.226.252 and 0.900.310.

The kind of locks to which applies the present invention is a lock with a programming device, which comprises a stator, a bore provided in said stator, a rotor rotatably mounted in said stator bore and a keyhole hollowed in said rotor, and wherein the programming device comprises in the stator a longitudinal groove made in said stator bore and a series of stator seats, which in case can contain counterpins and the respective springs, and comprises in the rotor:—a series of first seats intersecting said keyhole and a series of second seats parallel to said first seats;—a first slot and a second slot, orthogonal with respect to said seats and parallel to the rotor axis;—a series of key followers inserted with longitudinal and transversal mobility in said first rotor seats for cooperating with the conformations of a key inserted into said keyhole, each key follower having on one side some projections and on the other side an element for sliding engagement, and having an associated spring;—a series of locking pins slidingly inserted in said second rotor seats corresponding to said stator seats and possible counterpins and having a series of first recesses facing said projections of the key followers and a series of second recesses turned on the side opposite said key followers;—a stop bar inserted in said first rotor slot, having projections facing said second recesses of the locking pins, and a projection turned on the side opposite said locking pins and suitable for cooperating with said stator groove for allowing an outward displacement of the stop bar;—first springs associated to said stop bar and stressing the same outwards;—a change bar, inserted in said second rotor slot, having slidable engagement elements engaged with said sliding engagement elements of the key followers, and having a projection turned on the side opposite the key followers and suitable for cooperating with said stator groove for allowing an outward displacement of the change bar;—said component parts being coordinated in such a way that said projections of the stop bar engage said second recesses of the locking pins when the projection of the stop bar does not correspond to said stator groove, and disengage therefrom when the stop bar corresponds to said stator groove, displaces outwards under action of said first springs and determines for the lock a position for insertion and retraction of the key, whereas said key followers engage said second recesses of the locking pins when the projection of the change bar does not correspond to said stator groove and disengage therefrom when said change bar corresponds to said stator groove, displaces outwards by dragging with them the key followers by action of the respective sliding engagement elements, and determines for the lock a position of key change in which said key followers are disengaged from said locking pins and allow replacing the key with consequent different programming of the lock.

The document US 2005/217330 A1 is regarded an the closest prio art and partially corresponds to the preamble of claim 1.

A general drawback of the known programmable locks is that, if the key intended for programming the lock is inserted in incomplete manner, the lock receives a faulty programming which, then, it is not easy to correct.

Therefore there is a request for adding a protection against faulty programming due to incomplete key insertion.

In addition, in most known programmable locks there are also provided second springs associated with said change bar, which springs stress the change bar outwards whereby, when the lock is situated in the change position, the protrusion of the change bar engages the stator groove, the change bar displaces outwards, cancels the lock programming and allows a new programming. Therefore, the change bar displaces automatically outwards, by disengaging the key followers from the locking pins, each time the key is brought in the change position.

However, it is needed to prevent that the lock loses its programming by chance if the key is extracted when it is in the change position, even if the user was not intended to change the programming. To this aim, according to the document EP 0.900.310 there is provided, near the outer end of rotor, a fork ring engaging a recess of the key and preventing its extraction when the key is not in the position for insertion and extraction. In this case, the change of programming is possible only by using a special change key whose shape is such that it is not retained by the fork ring.

All this complicates the lock structure and involves complicated actions, difficulties and obstacles for the user who is intended to modify the lock programming. Moreover, because a special key is needed for effecting the change, it is not possible to arrange the lock for using normal keys available in commerce, a possibility which would be of great technical and commercial interest.

SUMMARY OF THE INVENTION

The general object of this invention is to improve a lock of the considered kind in order to make up for the stated drawbacks.

Therefore, the main object of the invention is to prevent effecting a faulty programming due to an incomplete insertion of the key.

Moreover, it is an object the invention that of allowing to effect the wanted programming without introducing any complication in the lock structure and by simplifying at the highest degree the process of programming change, however always preventing a not wanted loss of the lock programming.

It is still an object of the invention to give the possibility of arranging the lock for the use of normal keys available in commerce.

SUMMARY OF THE INVENTION

These objects are attained, in a lock of the kind stated in the preamble, in that the lock includes a security device intended to prevent a wrong effectuation of a change operation by hindering the inward displacement of the change bar in the case in which the key intended to programming the lock is inserted in an incomplete manner.

It is of advantage that said security device comprises a stop member mounted at the distal end of rotor for displacement in a direction perpendicular to the axis of rotor and to the displacement direction of the change bar, said stop member is susceptible to take a first position, towards which it is pushed by a spring, in which first position it hinders the inward displacement of the change bar, and said stop member is displaced, by the end portion of a key completely inserted into the lock, to a second position in which it does not hinder the displacements of the change bar.

Preferably, the change bar is arranged for taking or keeping, even when the key is in the change condition, a position in which the change bar retains the engagement between at least some of the key followers and locking pins; and in that there is provided a change means which can be operated by the user from the outside in order to displace the change bar in the position in which the same disengages all the key followers from the locking pins, when the used is intended to effect the key change.

In this way, even when the key is brought in the change position, the change bar retains the engagement between at least a part of the key followers and the locking pins. This is sufficient for preventing the extraction of the key from the lock and thus preventing a not wanted loss of the lock programming. Only if the special change means is then voluntarily operated for displacing the change bar outwards, the change bar displaces all the key followers in the position in which they do not engage the locking pins, and therefore renders possible the key extraction and a new lock programming.

Preferably, the change bar is provided for keeping or assuming, even when the key is situated in the change position, a position in which the change bar retains the coupling among at least some of the key followers and locking pins, thanks to the absence of a part of all the springs which usually stress outwards the change bar. In this way, the wanted operation is attained without complicating the lock structure, or even by simplifying said structure.

Preferably, the change bar cooperates with a single spring which pushes it outwards and is situated at the end of the change bar which is more remote from the opening for insertion of the key, whereby in the change position the change bar takes an inclined position in which it retains the engagement among the key followers and the locking pins which are situated in the region more near to the opening for insertion of the key.

Preferably, said change means which may be operated from outside in order to displace the change bar to the position in which it disengages all the key followers from the locking pins consists in that the lock has, sideways the opening for insertion of the key, a hole facing the change bar, and in that there is provided a change shaft suitable for acting from said hole onto the change bar in order to displace the same outwards.

Preferably, the operation of said change shaft if favored by the change bar having, in register with said hole, an inclined portion onto which should operate said change shaft in order to displace outwards the change bar as a consequence of its own insertion.

BRIEF DESCRIPTION OF THE DRAWINGS

These and other features, objects and advantages of the subject of the present invention will more clearly appear from the following description of some embodiments, being not limiting examples, with reference to the accompanying drawings, wherein.

DETAILED DESCRIPTION OF THE PREFERRED EMBODIMENT

Figure 1:
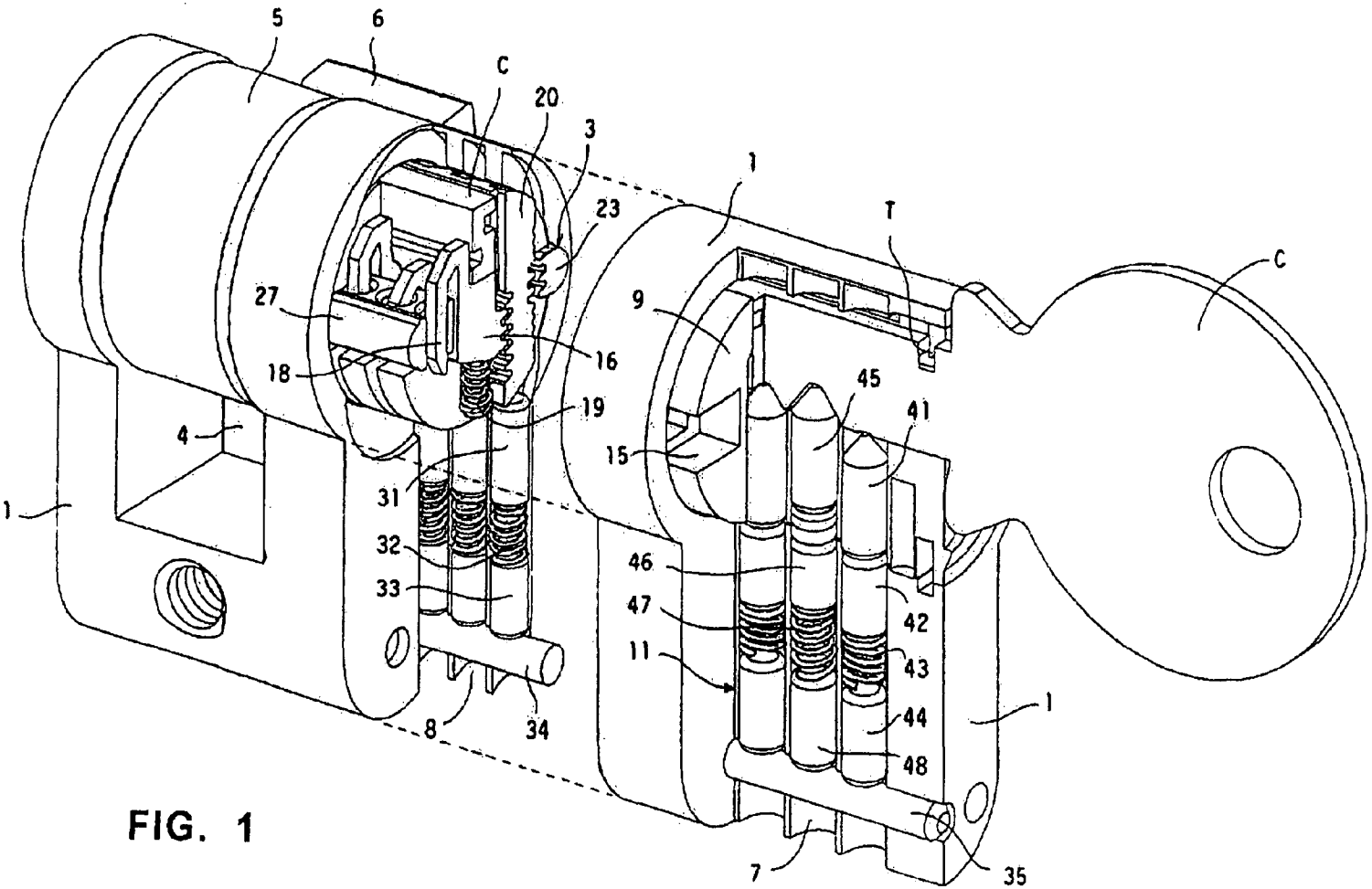
FIG. 1 represents in axonometric perspective a lock embodiment, partially interrupted and having some outer parts sectioned in order to show some inner parts.
Figure 4:
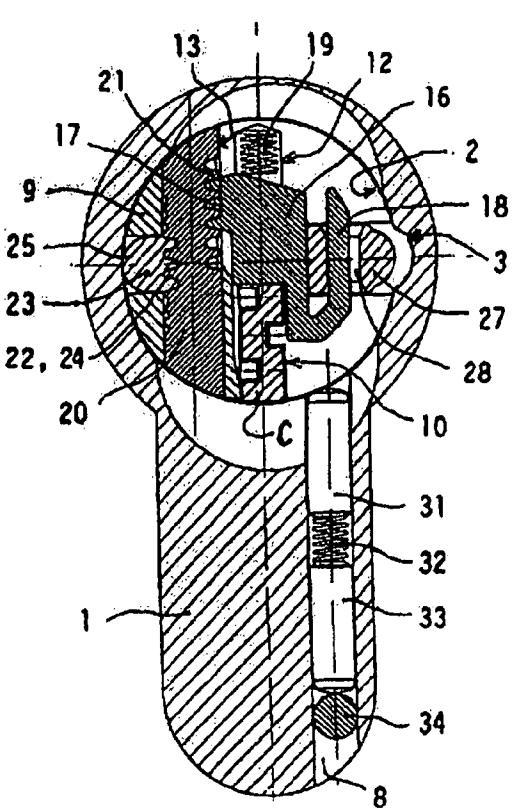
FIG. 4 shows a cross section corresponding to those of FIGS. 2 and 3, and represents the lock as it appears when the key has been rotated into the change position.
Figure 3:
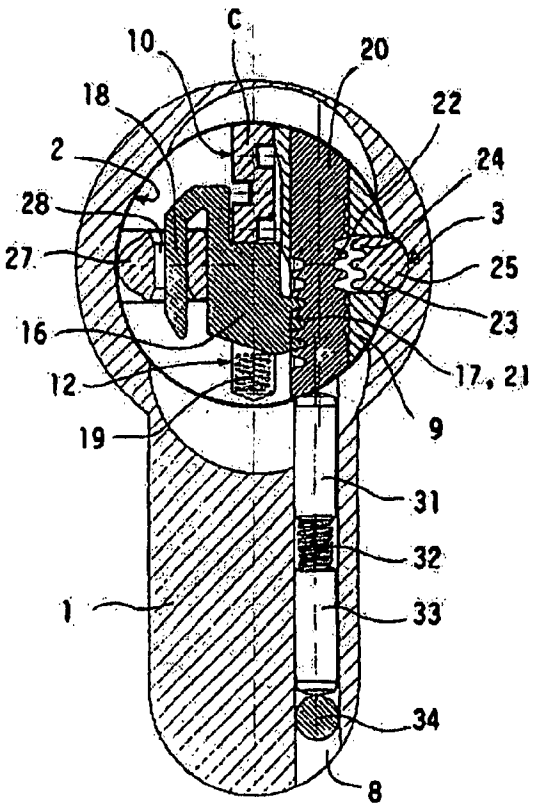
FIG. 3 shows a cross section corresponding to FIG. 2, and shows the lock as it appears when the correct key has been inserted into the lock.
Figure 2:
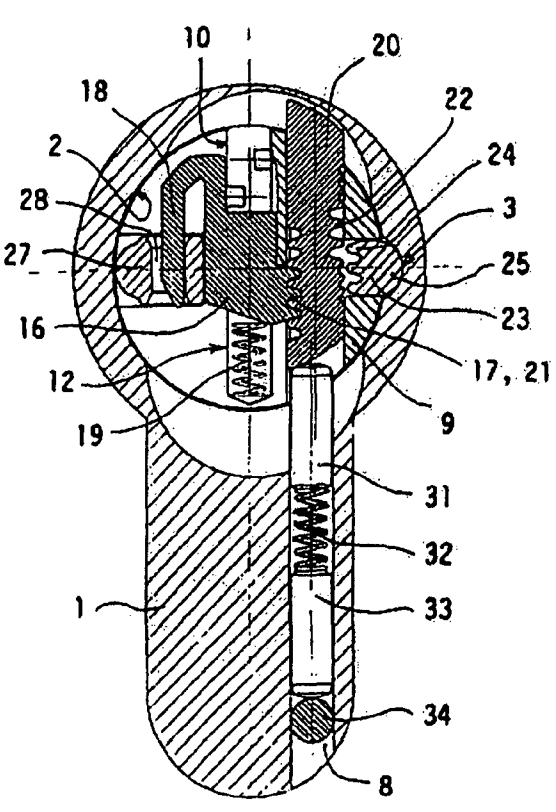
FIG. 2 shows a cross section of the lock as it appears in the absence of a key inserted into the lock.
Figure 6:
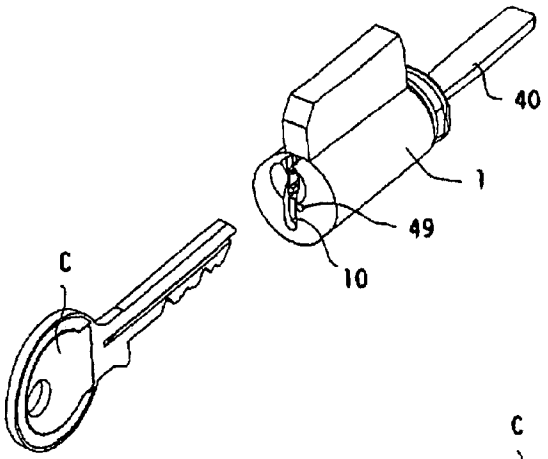
FIG. 6 shows in perspective the lock along with the corresponding key which has not yet been inserted into the lock.
Figure 7:
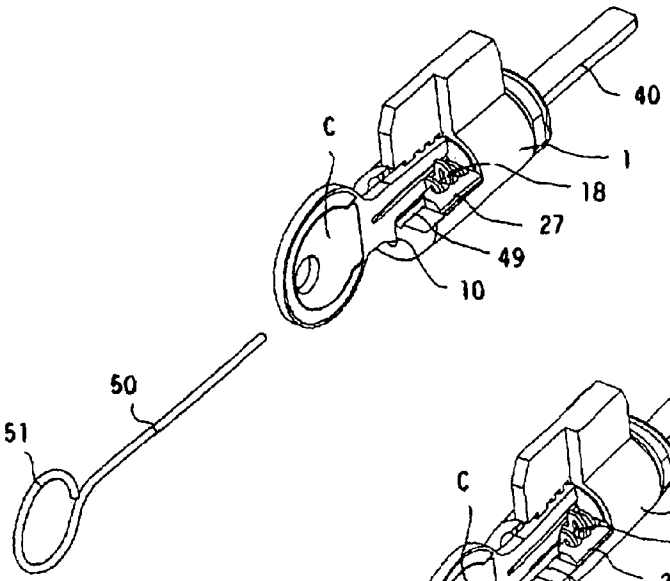
FIG. 7 shows, in a manner similar to FIG. 6, the lock with some parts removed for showing the inner parts and with the key inserted into the lock, and shows the change shaft which has not yet been inserted into the lock.
Figure 8:
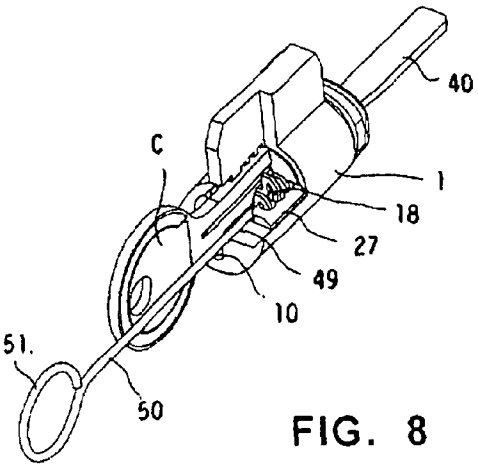
FIG. 8 shows, in a manner similar to FIGS. 6 and 7, the lock with some parts removed for showing the inner parts and with the key inserted into the lock, and with the change shaft inserted into the lock.

With reference to FIGS. 1 to 5, a lock of the kind to which the invention is applied includes, in an embodiment, a stator 1 having a cylindrical bore 2 for a rotor 9; along bore 2 extends, at least in correspondence of the programming device, a longitudinal side groove 3. In the represented embodiment, stator 1 has a recess 4 for receiving a ring 5 with a web 6 forming the operative member of the lock, but in other embodiments this web 6 can be replaced by different members, for example by a key as represented in FIGS. 6 to 8. Stator 1 also has vertical channels 7 and 8 intended to house counterpins 31 of the lock.

Rotor 9 is cylindrical and it has a keyhole 10 for inserting a key C.

Rotor 9 is installed inside bore 2 of stator 1. Rotor 9 includes a series of first seats 12 which intersect the keyhole 10 for the key C, and it includes a series of second seats 13, parallel to the first seats 12, a first slot 14 and a second slot 15, orthogonal with respect to said seats and parallel to the rotor axis. For each unit of the programming mechanism, a key follower 16 is inserted with longitudinal and transversal mobility in one of said first rotor seats 12 for cooperating with the conformations of a key C inserted in said keyhole 10. The key follower 16 is provided on one side with projections 17 and on the opposite side with an element 18 for sliding engagement, and it is associated with a spring 19 which stresses the key follower towards the keyhole 10. A locking pin 20 is slidingly inserted in one of said second rotor seats 13, and it is provided with a series of first recesses 21 facing said projections 17 of the key follower 16, and with a series of second recesses 22 turned on the side opposite said key follower 16. A stop bar 23 is inserted in said first rotor slot 14, and it has projections 24 facing said second recesses 22 of the locking pins 20, and a projection 25 turned on the side opposite said locking pins and suitable for cooperating with said stator groove 3. The stop bar 23 is associated with first springs 26 which stress the stop bar outwards. A change bar 27 is inserted in said second orthogonal rotor slot 15, and it is provided with slidable engagement elements 28 engaged with said sliding engagement elements 18 of the key followers 16, and with a projection turned on the side opposite the key followers 16 and suitable for cooperating with said stator groove 3.

In the known embodiment shown in FIGS. 1 to 4, a counterpin 31 is inserted in the stator channel 8 for cooperating with the locking pin 20. The counterpin 31 is pushed by a spring 32 which, by means of a little block 33, rests against a retainment bar 34 inserted in a corresponding stator hole. Such counterpins 31 may be foreseen in order to give more strength to the lock, however they are not necessary and may be omitted.

It is to be remarked that the change bar 27, in the known embodiments, is associated with springs which stress the change bar outwards. Such springs, or at least a part of them, may be omitted in certain embodiments of the present invention, as described later on.

According to the invention, the lock includes a security device intended to prevent a faulty execution of a change operation. This security device operates by preventing the inward displacement of the change bar in the case that the key intended to establish the lock programming has been inserted in an incomplete manner.

Figure 14:
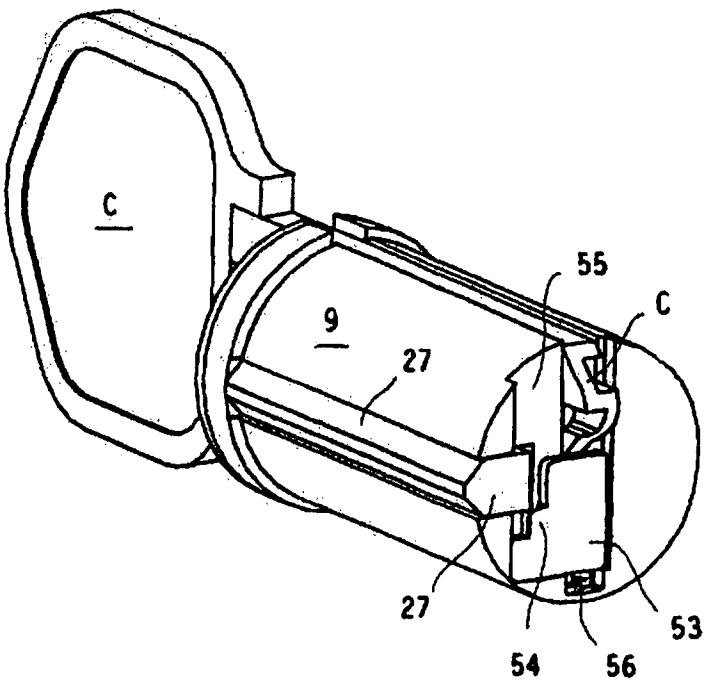
FIG. 14 shows the security device of FIG. 13, in the condition in which a change key has been inserted in complete manner, and the security device does not prevent the inward displacement of the change bar.
Figure 13:
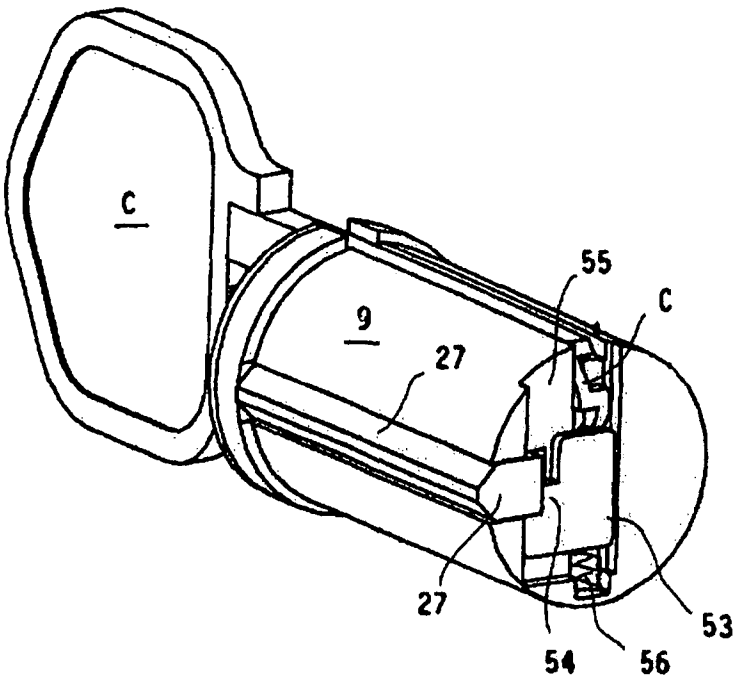
FIG. 13 shows a security device intended to prevent a faulty execution of a change operation, in the condition in which a change key has been inserted in incomplete manner, and the security device prevents the inward displacement of the change bar.

An embodiment of the security device according to the invention is represented in FIGS. 13 and 14. According to FIG. 13, the key C is in the change position, but it is only partially inserted, whereas according to FIG. 14 the key C is completely inserted. The security device comprises a stop member shaped as a plate 53 mounted at the distal end of rotor 9. Plate 53 can displace within a guide member 55 perpendicular to the axis of rotor 9 and to the displacement direction of the change bar 27. Plate 53 is susceptible of assuming a first position, represented in FIG. 13 and it is stressed towards this first position by a spring 56. In this first position plate 53 prevents, by its own shoulder 54 the inward displacement of the change bar 27. Therefore, if the key C has not been completely inserted, the change bar 27 retains engaged with its projection in the groove 3 of stator 1, and rotor 2 cannot be displaced from the change position. If, on the contrary, the key C has been inserted in complete manner into rotor 2, as according to FIG. 14, the distal end portion of key C, always having an inclined surface, repels plate 53 against the action of spring 56 into the second position, in which the shoulder 54 does not hinder the inward displacement of the change bar 27. Therefore this latter can displace inwards as a consequence of the rotation of the key C, and the new lock programming is then established.

In this way, a faulty execution of the change operation, due to an incomplete insertion of the key intended for the new programming, is certainly prevented.

As already said, according to a feature of the invention the springs stressing outwards the change bar may be at least partially omitted, in order that the key cannot be unintentionally extracted when in the position of change.

In this case, the operation of the described mechanism is as follows:

In the absence of a key (FIG. 2), the locking pins 20 and possible counterpins 31 pass through the coupling surface between stator 1 and rotor 9, and they prevent the rotor rotation. The locking pins 20 are rendered solid with the key followers 16 by the mutually engaged toothings 17 and 21. Under action of springs 26, the stop bar 23 is inserted with its projection 23 in the stator groove 25, and therefore the toothings 22 and 24 are mutually disengaged and the displacement of the locking pins 20 along with the key followers 16 is free when a key is inserted or extracted.

When the correct key is inserted (FIG. 3), the end portions of the locking pins 20 (and possible counterpins 31) are brought to correspond to the coupling surface between stator 1 and rotor 9, whereby rotor 9 can be rotated by 360° in order to operate the lock. When effected this rotation, all elements take again their initial positions, and the key can be extracted.

When, on the contrary, rotor 9 is rotated by 180° into a change position (FIG. 4), the change bar 27 is situated with its projection corresponding to the stator groove 3. However, in the at least partial absence of springs stressing the change bar 27, this latter is not completely displaced outwards and at least some toothings 17 of the key followers 16 remain engaged with the teeth 21 of the locking pins 20, which are blocked in their position by the stop bar 23 which, no more corresponding to the groove 3, maintains mutually engaged the toothings 22 and 24. Therefore, in this position it is not possible to unintentionally extract the key C and lose the lock programming.

Figure 5:
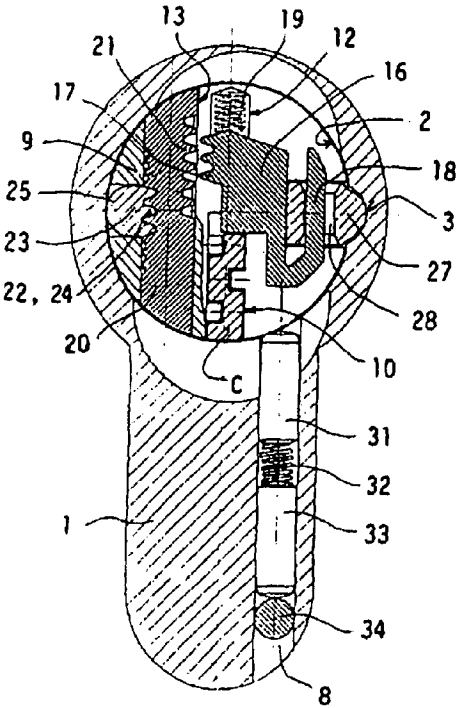
FIG. 5 shows a cross section corresponding to those of FIGS. 2, 3 and 4, and represents the lock as it appears when the change bar has been displaced outwards for allowing changing the key.

If, on the contrary, the user who is willing to program in a different manner the lock effects from outside a maneuver which brings the change bar 27 to displace outwards by entering its projection into the stator groove 3, as shown by FIG. 5, the elements 18 and 28 of sliding engagement, mutually engaged, displace in transversal direction the key followers 1.6 by mutually disengaging the toothings 17 and 21, whereas the stop bar 23 still blocks the locking pins 20 in their positions. Therefore, in this position it is possible to extract the key, and then all key followers 16 are pushed by springs 19 at the end of their strokes, and the lock loses its former programming.

By then inserting a new key, the key followers take a programming position corresponding to this new key. By rotating again rotor 2 by 180°, the lock takes again its initial position according to FIG. 3, but now it is programmed according to the codification of the new key.

In addition to the described programming mechanisms, the lock may include mechanisms with locking pins and counterpins of conventional type, which in the example are represented by locking pins 41 inserted into bores 11 of rotor 9, by counterpins 42, springs 43 and rest blocks 44 inserted in channels 7 of stator 1 and kept in place by retainment bars 35. These per se well known mechanisms can be adopted with advantage in addition to the programming mechanisms, but a lock according to the invention can well be realized without making use of mechanisms of this type.

In a similar manner, if desired, in the lock according to the invention may be included the mechanisms characteristic of the locks with master keys, wherein the locking pins 45 are divided in two or more sections in their regions near the surface separating them from the counterpins 46.

Figures from 6 to 12 show a particular embodiment of the change means intended to push outwards the change bar 27 when the user, after having brought the key C in the change position, intends to effect a new programming of the lock.

FIG. 6 shows in perspective the lock along with the corresponding key C which has not yet been inserted into the lock. As it may be remarked, stator 1 has, next to the opening of keyhole 10, a hole 49 facing the change bar 27. This is better observable in FIG. 7, wherein a portion of stator 1 has been removed for representing the inner parts.

FIG. 7 shows the lock with the key inserted into the lock. The key C has displaced, corresponding to its codification, the key followers 16 of the lock, of which are visible here only the elements 18 of sliding engagement, but the change bar 27 has not displaced outwards, whereby the key C cannot be extracted by inadvertence.

FIG. 7 also shows a change member formed by a change shaft 50 provided with a handle ring 51. Here, this change shaft has not yet been inserted into the lock, and it is intended to be introduced in the hole 49 for allowing programming the lock.

In FIG. 8 the change shaft 50 has been inserted into the lock by introducing the same into the hole 49. The change shaft has operated onto the change bar 27 by displacing the same outwards. The change bar 27, by acting as represented in FIG. 5, has dragged with them the key followers 16 of the lock by acting on their engagement elements 18, and has disengaged the key followers from the locking pins, which are always retained by the stop bar. Therefore, the key followers are now free to displace along their own longitudinal direction, and they do not hinder extracting the key and then inserting a new key, which will operate the new lock programming.

After removal of the change shaft 50 the lock, which is now programmed according to a new codification, takes again its normal operation and, in particular, the key rotation, by bringing the change bar 27 out of the correspondence with the groove 3, causes an inward displacement of the change bar and, as a consequence, a new engagement of the key followers with the locking pins of the lock.

Figure 9:
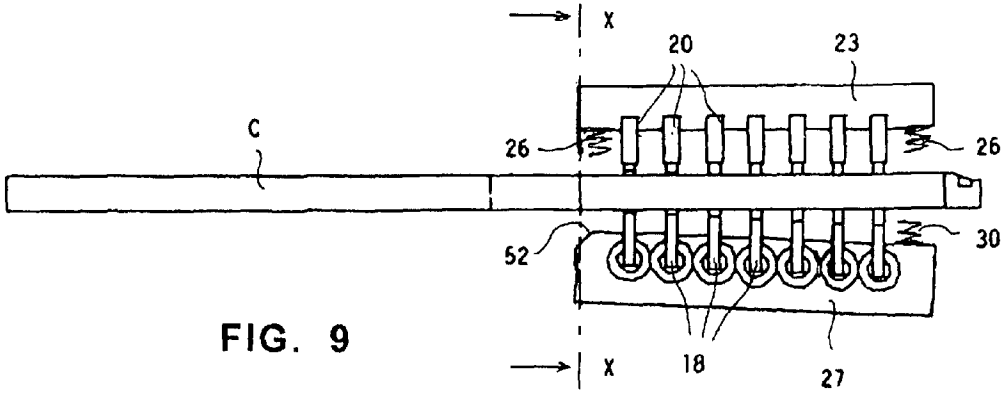
FIG. 9 shows, in a cross section perpendicular to the key plane and in a particular embodiment, the positions of the key followers, the locking pins, the stop bar and the change bar, in a condition corresponding to that of FIG. 7.
Figure 11:
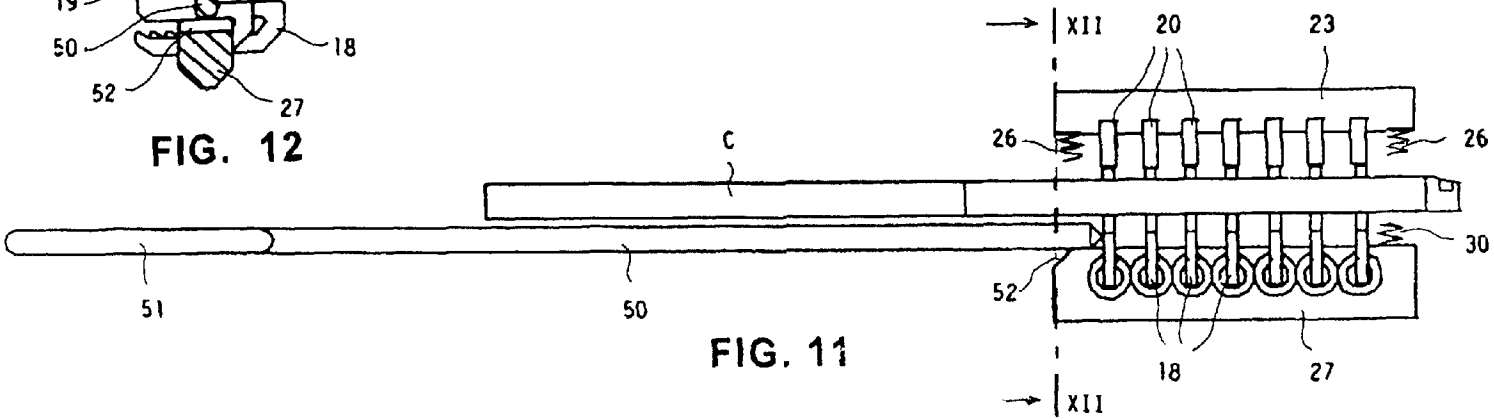
FIG. 11 shows, in a manner similar to that of FIG. 9, the positions of the key followers, the locking pins, the stop bar and the change bar, in a condition corresponding to that of FIG. 8.
Figure 10:
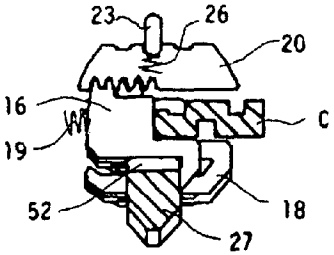
FIG. 10 shows in a cross section the position of the key followers, the locking pins, the stop bar and the change bar, in a condition corresponding to that of FIG. 9.
Figure 12:
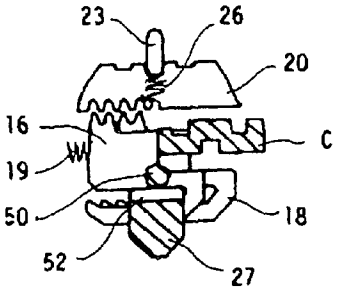
FIG. 12 shows in a cross section the positions of the key followers, the locking pins, the stop bar and the change bar, in a condition corresponding to that of FIG. 11.

FIG. 9 shows a particular embodiment wherein the change bar 27 cooperates with a single spring 30. Spring 30 stresses the change bar outwards and it is situated near the end of the change bar 27 which is far from the opening of the keyhole. As a consequence, in the change position the change bar 27 takes an inclined position, as represented, in which it retains the engagement between the key followers and the locking pins in the region near the opening of the keyhole. This is sufficient for preventing a unintentional extraction of the key C. Moreover, at its end turned toward the opening of the keyhole (and therefore corresponding to the formerly described hole 49) the change bar 27 has an inclined portion 52 on which is intended to operate the change bar 50 for displacing outwards the change bar as a direct consequence of its insertion, as represented in FIG. 11. As already described, the displacement outwards of the change bar 27 disengages the key followers from the locking pins of the lock, thus allowing the extraction of the key and the insertion of a new key, with the consequent new programming of the lock.

As an alternative to the embodiment described and preferred, it is possible to provide a short change shaft 50 permanently inserted within the hole 49 and lightly projecting from the front surface of rotor 9, or from a recess thereof, by forming a push-button whose pressing replaces the described introduction of the change member 50-51.

As it may be remarked, the application of the invention does not worsen the inevitable complexity of a lock of the king taken into consideration, whereby the manufacture of the lock according to the invention is relatively easy and advantageous. In addition, the lock programming operations effected by the user become of the greatest simplicity and, at the same time, they offer the greatest security.

Is remarkable the fact that, because there is no need of using special keys for programming the lock, this latter can be designed in such a way that it accepts normal keys offered by the market, and this fact is very advantageous from the technical and commercial points of view.

It should be understood that this invention is not limited to the embodiment described and shown as an example. Several possible modifications have been pointed out in the course of the description, and others are within the ability of those skilled in the art. These modification and others, and any replacement by technically equivalent means, can be made to what has been described and shown, without departing from the spirit of the invention and the scope of this Patent as defined by the appended Claims.

The invention claimed is:

1. A programmable lock, comprising:

a stator (1), a rotor (9) rotatably inserted in stator (1), a keyhole for a key (C), formed in said rotor (9), a longitudinal groove (3) formed in said stator (1), a set of key followers (16) inserted with longitudinal and transversal mobility in said rotor (9) for cooperating with the teeth of the key (C) inserted in said keyhole, each key follower (16) having an element (18) of sliding coupling and having an associated spring (19), a set of locking pins (20) inserted with a longitudinal mobility in said rotor (9), said key followers (16) and locking pins (20) having means for mutual coupling, a stop bar (23) suitable for cooperating with said groove (3) of stator (1) in order to allow displacement of said locking pins (20) or to immobilize the same, a change bar (27), having elements of sliding coupling (28) engaged with said elements of sliding coupling (18) of the key followers (16), and suitable for co-operating with said groove (3) of stator (1) in order to control the mutual coupling of said key followers (16) and locking pins (20), wherein said stop bar (23) blocks said locking pins (20) when the stop bar (23) does not correspond to said groove (3) of stator (1), and the stop bar (23) makes free displacement of the locking pins (20) when the stop bar corresponds to said groove (3) and determines a position of insertion and extraction of the key, wherein said key followers (16) are coupled with said locking pins (20) when said change bar (27) does not correspond to said groove (3) of stator (1), and are disengaged when said change bar corresponds to said groove (3) and determines a position of key change, wherein the programmable lock further comprises a security device (53-56) intended to prevent a faulty effectuation of a change operation, which security device operates by hindering inward displacement of the change bar (27) when the key (C) for programming the programmable lock is inserted in an incomplete manner.

2. The lock as set forth in claim 1, wherein said security device (53-56) comprises a stop member (53) mounted a distal end of the rotor (9) for displacement in a direction perpendicular to an axis of the rotor (9) and to the displacement direction of the change bar (27), said stop member (53) being susceptible to take a first position, towards which the stop member (53) is pushed by a spring (56), in which first position the stop member (53) hinders inward displacement of the change bar (27), and said stop member (53) is displaced, by the end portion of the key (C) completely inserted into the lock, to a second position in which it does not hinder the inward displacement of the change bar (27).

3. The lock as set forth in claim 1, wherein said change bar (27) is provided for keeping or assuming, even when the key (C) is situated in the change position, a position the change bar (27) retains the coupling among at least some of the key followers (16) and locking pins (20), and in that wherein there is provided a change means (50-51) suitable for being operated from outside, for displacing the change bar (27) to the position in which the change bar (27) disengages all the key followers (16) from the locking pins (20), when the user intends to proceed changing of the key (C).

4. The lock as set forth in claim 3, wherein the change bar (27) is provided with springs which stress outwards the change bar (27) only in an incomplete manner.

5. The lock as set forth in claim 4, wherein the change bar (27) cooperates with a single spring (30) which pushes the change bar (27) outwards and is situated at the end of the change bar (27) which is more remote from the opening (10) for insertion of the key (C), whereby in the change position the change bar (27) takes an inclined position in which it retains the engagement among the key followers (16) and the locking pins (20) which are situated in the region more near to the opening (10) for insertion of the key (C).

6. The lock as set forth in claim 4, wherein said change means (50-51) which may be operated from outside in order to displace the change bar (27) to the position in which the change bar (27) disengages all the key followers (16) from the locking pins (20) consists in that the lock has, sideways the opening (10) for insertion of the key (C), a hole (49) facing the change bar (27), and wherein there is provided a change shaft (50) suitable for acting from said hole (49) onto the change bar (27) in order to displace the same outwards.

7. The lock as set forth in claim 6, wherein said change shaft (50) forms a tool (50-51) intended to be inserted from outside into the hole (49) in order to effect the change operation.

8. The lock as set forth in claim 6, wherein said change shaft (50) is permanently inserted within the hole (49) and the change shaft (50) slightly projects from the front surface of rotor (9) or from a notch thereof, forming a button intended to be pressed in order to effect the change operation.

9. The lock as set forth in claim 6, wherein operation of said change shaft (50) is favored by the change bar (27) having, in register with said hole (49), an inclined portion (52) onto which should operate said change shaft (50) in order to displace outwards the change bar (27) as a consequence of the operation of the change shaft (50).

10. The lock as set forth in claim 1, wherein the lock is so configured to accept normal keys offered by market.

* * * * *